US006735918B2

(12) United States Patent
Haslem et al.

(10) Patent No.: US 6,735,918 B2
(45) Date of Patent: May 18, 2004

(54) PLASTIC SLAB BOLSTER UPPER

(75) Inventors: Dale R. Haslem, Claremont, CA (US); Kenneth Lee, Anaheim, CA (US); Scott Shaw, Redlands, CA (US)

(73) Assignee: Aztec Concrete Accessories, Inc., Fontana, CA (US)

( * ) Notice: Subject to any disclaimer, the term of this patent is extended or adjusted under 35 U.S.C. 154(b) by 0 days.

(21) Appl. No.: 10/223,387

(22) Filed: Aug. 19, 2002

(65) Prior Publication Data

US 2003/0009979 A1 Jan. 16, 2003

Related U.S. Application Data

(63) Continuation-in-part of application No. 09/904,152, filed on Jul. 12, 2001.

(51) Int. Cl.[7] ..... E04C 5/16

(52) U.S. Cl. ..... 52/677; 52/687

(58) Field of Search ..... 248/49, 677, 70, 248/440; 52/677, 687, 691, 334, 126.6, 177, 181, 647, 396.02, 393; 404/70, 62

(56) References Cited

U.S. PATENT DOCUMENTS

| | | | | | |
|---|---|---|---|---|---|
| 1,101,767 | A | | 6/1914 | Walker | |
| 1,720,193 | A | * | 7/1929 | White | 52/649.1 |
| 2,829,572 | A | * | 4/1958 | Vanek | 404/62 |
| 3,283,464 | A | | 11/1966 | Litzka | 52/636 |
| 3,400,508 | A | * | 9/1968 | Dietner et al. | 52/691 |
| 3,401,497 | A | | 9/1968 | Gregory, Jr. et al. | 52/677 |
| 3,626,653 | A | | 12/1971 | Amirikian | 52/734 |
| 3,825,465 | A | | 7/1974 | Stock | 161/112 |
| 4,201,023 | A | * | 5/1980 | Jungbluth | 52/334 |
| 4,213,281 | A | | 7/1980 | Zarzosa-Castilla et al. | 52/323 |
| D279,352 | S | | 6/1985 | Mitchell et al. | D8/354 |
| 4,689,867 | A | | 9/1987 | Tolliver | 29/453 |
| 4,756,641 | A | | 7/1988 | Hartzheim | 404/136 |
| 4,899,497 | A | * | 2/1990 | Madl, Jr. | 52/126.6 |
| 4,942,714 | A | | 7/1990 | Langley, Jr. et al. | 52/687 |
| 4,996,816 | A | | 3/1991 | Wiebe | 52/742 |
| 5,044,136 | A | | 9/1991 | Liu | 52/252 |
| D334,133 | S | | 3/1993 | Hartzheim | D8/354 |
| 5,207,045 | A | | 5/1993 | Bodnar | 52/600 |
| D354,672 | S | | 1/1995 | Van de Peer | D8/354 |
| 5,588,273 | A | | 12/1996 | Csagoly | 52/634 |
| D383,373 | S | | 9/1997 | Boeshart | D8/354 |
| 5,664,378 | A | | 9/1997 | Bettigole et al. | 52/414 |
| 5,664,390 | A | | 9/1997 | Sorkin | 52/687 |
| 5,729,949 | A | | 3/1998 | Hartzheim | 52/677 |
| D393,997 | S | | 5/1998 | Hartzheim | D8/354 |
| D394,200 | S | | 5/1998 | Hartzheim | D8/354 |
| 5,758,456 | A | | 6/1998 | Case | 52/177 |
| 5,791,816 | A | | 8/1998 | McCallion | 404/136 |
| 5,833,206 | A | * | 11/1998 | Peacock | 248/677 |
| 5,941,035 | A | | 8/1999 | Purse | 52/263 |
| 5,956,912 | A | | 9/1999 | Carter et al. | 52/396.02 |
| 6,012,256 | A | | 1/2000 | Aschheim | 52/167.1 |
| D421,709 | S | | 3/2000 | Haslem et al. | D8/354 |
| 6,044,598 | A | | 4/2000 | Elsasser et al. | 52/181 |
| 6,073,293 | A | | 6/2000 | Ahlskog et al. | 14/73 |
| D428,501 | S | | 7/2000 | Haslem et al. | D25/199 |
| 6,089,522 | A | | 7/2000 | Haslem et al. | 248/440 |
| 6,092,960 | A | * | 7/2000 | McCallion | 404/70 |
| 6,210,070 | B1 | * | 4/2001 | Shaw et al. | 404/70 |
| 6,447,203 | B1 | * | 9/2002 | Ruiz et al. | 404/70 |
| 6,502,791 | B2 | * | 1/2003 | Parker | 248/70 |

FOREIGN PATENT DOCUMENTS

| | | | |
|---|---|---|---|
| CH | 683933 | 6/1994 | E04C/5/16 |
| DE | 3342342 | 5/1985 | E04F/15/14 |

* cited by examiner

*Primary Examiner*—Leslie A. Braun
*Assistant Examiner*—Tan Le
(74) *Attorney, Agent, or Firm*—Wood, Herron & Evans LLP

(57) ABSTRACT

A slab bolster upper for supporting rebar in a reinforced concrete structure while the concrete is poured and thereafter cures, is of molded plastic construction and is formed with horizontal and vertical voids that facilitate concrete placement and break up potential shear planes. Opposite ends of each unit are provided with complementary buckles to interconnect with like units to form a continuous support of desired length.

9 Claims, 18 Drawing Sheets

PLASTIC SLAB BOLSTER UPPER

CROSS REFERENCE TO RELATED APPLICATION

This application is a continuation-in-part of co-pending U.S. patent application Ser. No. 09/904,152 filed Jul. 12, 2001 and entitled PLASTIC SLAB BOLSTER UPPER, the disclosure of which is incorporated herein by reference in its entirety as if completely set forth herein below.

BACKGROUND OF THE INVENTION

In reinforced concrete construction, it is necessary to support the reinforcing bars ("rebars") in their designated locations during placement of the concrete and thereafter as it cures. This is accomplished in its most rudimentary form by simply resting the rebar on pieces of concrete placed on the form surface. Obviously, this approach may be unsatisfactory for many reasons, such as the lack of any means for fixing the rebar at their designed positions, as a result of which the rebar may be displaced as the concrete is poured.

In response to the shortcomings of this method of supporting rebar, welded wire supports have been developed and are used extensively in the reinforced concrete construction industry. For example, U.S. Pat. No. 4,689,867 is directed to a welded wire rebar of one type, while U.S. Pat. No. 4,996,816 describes another welded wire rebar support design. With metal supports, however, there is a potential problem of corrosion. Coating the wire with epoxy is a method of dealing with this problem, but coating is expensive, and if the coating is damaged, corrosion may still occur.

Plastic supports are generally non-corrodible and therefore overcome the problems noted above with welded wire supports, but they usually lack the open construction provided by wire supports that permits full flow of concrete through and around the support during concrete placement. While U.S. Pat. Nos. 5,729,949 and 6,089,522 disclose supports that may be formed of plastic and have openings formed in them to facilitate concrete placement, the supports shown in these patents are individual units as opposed to supports that may extend for several spans. U.S. Pat. No. 5,664,390 discloses a plastic bolster that may extend across several spans and uses a pair of spaced legs and a control body that resists deformation through the use of pin-like projections that bite into the underlying surface.

SUMMARY OF THE INVENTION

The above-noted problems associated with prior art bolsters are obviated by the bolster of the present invention. Specifically, the bolster of the present invention is preferably molded of non-corrodible plastic, is of inverted T-shape for greater stability, and provides an open construction that facilitates distribution of concrete during placement through and around the bolster.

The base of the bolster of the present invention may be molded integrally with the rebar support section that projects substantially perpendicularly away from an upper surface of the base and terminates in a rebar-engaging cap that extends in generally parallel relationship to the base. Both the base and the support section may be of truss-like construction, which results in a high weight-to-strength ratio, with a major portion of the base and web being occupied by voids, thereby enhancing concrete flow through and around the bolster.

In another preferred embodiment of the invention, the base may be molded with a series of posts spaced along and projecting from an upper surface and a rebar-engaging cap molded separately and mechanically interconnected to outer ends of the posts by means of joint elements molded in the posts and the cap. The latter may also be provided with transverse ridges on its outer rebar-engaging surface to break up shear planes. Additionally, the junctures of the posts and the base are strengthened by gussets that project upwardly from the base and extend both longitudinally and laterally of the base upper surface. To further strengthen the bolster, opposite longitudinal edges of the base are provided with continuous upstanding ribs, and the ribs and gussets further serve to break up shear planes.

The post construction of this embodiment is conducive to flexible injection mold tolling that can mold a wide range of sizes without the need for different molds for each size. The portions of the mold that forms the posts are simply adjusted.

The bolster of the present invention may be utilized separately, or in a preferred form of the invention, may be provided with complementary buckles at opposite ends to permit connection with like units to form a continuous bolster of desired length. In this regard, both the base and the rebar support section are each provided with complementary buckles so that the units, when interconnected, are joined at both their upper and lower extremities, thereby enhancing the strength and stability of the composite bolster.

In either case, that is, whether formed as discrete units or with interconnecting buckles, the bolsters may be formed of any convenient length to suit a desired application. In a preferred embodiment, the length is selected to facilitate handling and storage, e.g., about 2.5 feet in length. The inverted T-shape of the units, which permits the units to be nested, and the convenient unit length, greatly facilitate packaging the units for shipment.

The bolsters of the present invention may be formed from a variety of plastics, such as polycarbonate/acrylonitrile butadiene styrene (ABS), polyproylene, nylon, or ABS. Additionally, the plastic may be reinforced with a variety of fibers, such as fiberglass, Keviar, carbon fibers, or metal fibers.

These and other features and advantages of the bolster of the present invention will become more apparent from the following description.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
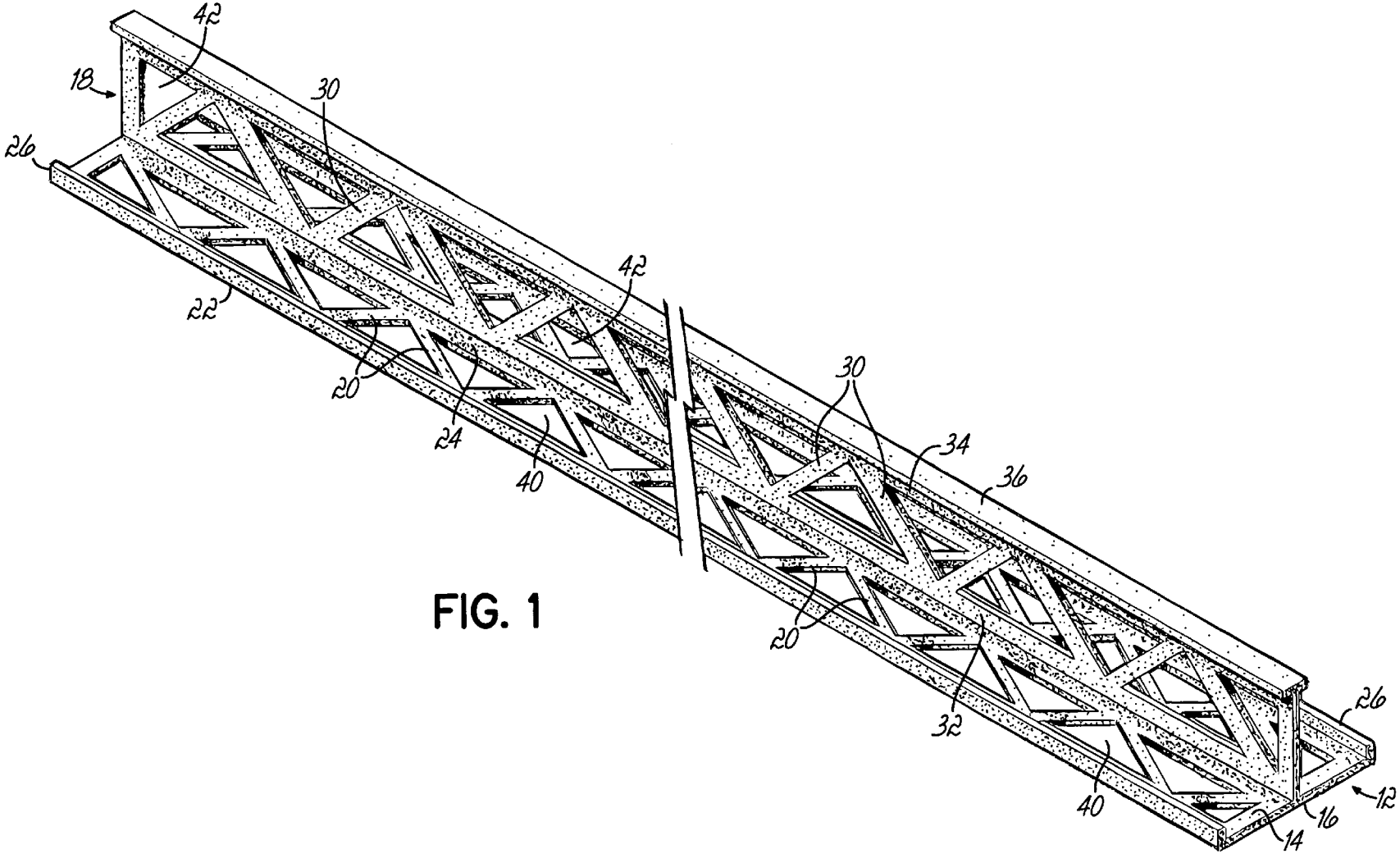
FIG. 1 is a perspective view of a slab bolster upper in accordance with the present invention.

With reference to FIG. 1 of the drawings, a slab bolster upper 10 in accordance with the first preferred embodiment of the invention comprises an elongated base 12 having upper and lower surfaces 14 and 16, respectively and an elongated rebar support section 18 connected to and projecting from the upper surface of the base for engaging and supporting reinforcing bars. As will readily be seen from FIG. 1, the base 12 has a truss-like construction comprising a series of struts 20 extending between spaced parallel outer edges 22 and a medial portion 24.

Upstanding ribs 26 extend longitudinally of said base at said outer edges 22 and project substantially perpendicularly upwardly from the upper surface 14 of the base 12. The rebar support section 18 is formed as a substantially planar web projecting substantially perpendicularly from the upper surface 14 of the base 12 substantially medially thereof. Similarly to the base 12, the rebar support section 18 comprises a series of struts 30 to provide a strong, yet open, truss-like configuration extending from a bottom, longitudinally extending lower rib 32 to a corresponding upper rib 34. Attached to the upper rib and extending substantially parallel to the base 12 is a rebar-engaging cap 36.

The slab bolster upper as shown in FIG. 1 may be formed by a variety of processes as is known in the art. For example, the slab bolster upper may be injection molded from a suitable plastic such as polycarbonate, polypropylene, and nylon and may be reinforced from various fibers, such as fiberglass, carbon fiber, and metal fibers. Other potential manufacturing processes for forming the slab bolster upper include extrusion, stamping, machining, or a combination of such processes. Additionally, it will be noted that with the truss-like construction of both the base and the rebar support section, the voids 40 and 42 through the base 12 and support section 18, respectively, comprise a major portion of the base and support section, whereby concrete, during placement, may flow freely through and around the base and the support section. Preferably, the openings 40 and 42 are made sufficiently large to permit the flow of sizable aggregate of up to 1.5 inches through the base and support section.

Figure 2:
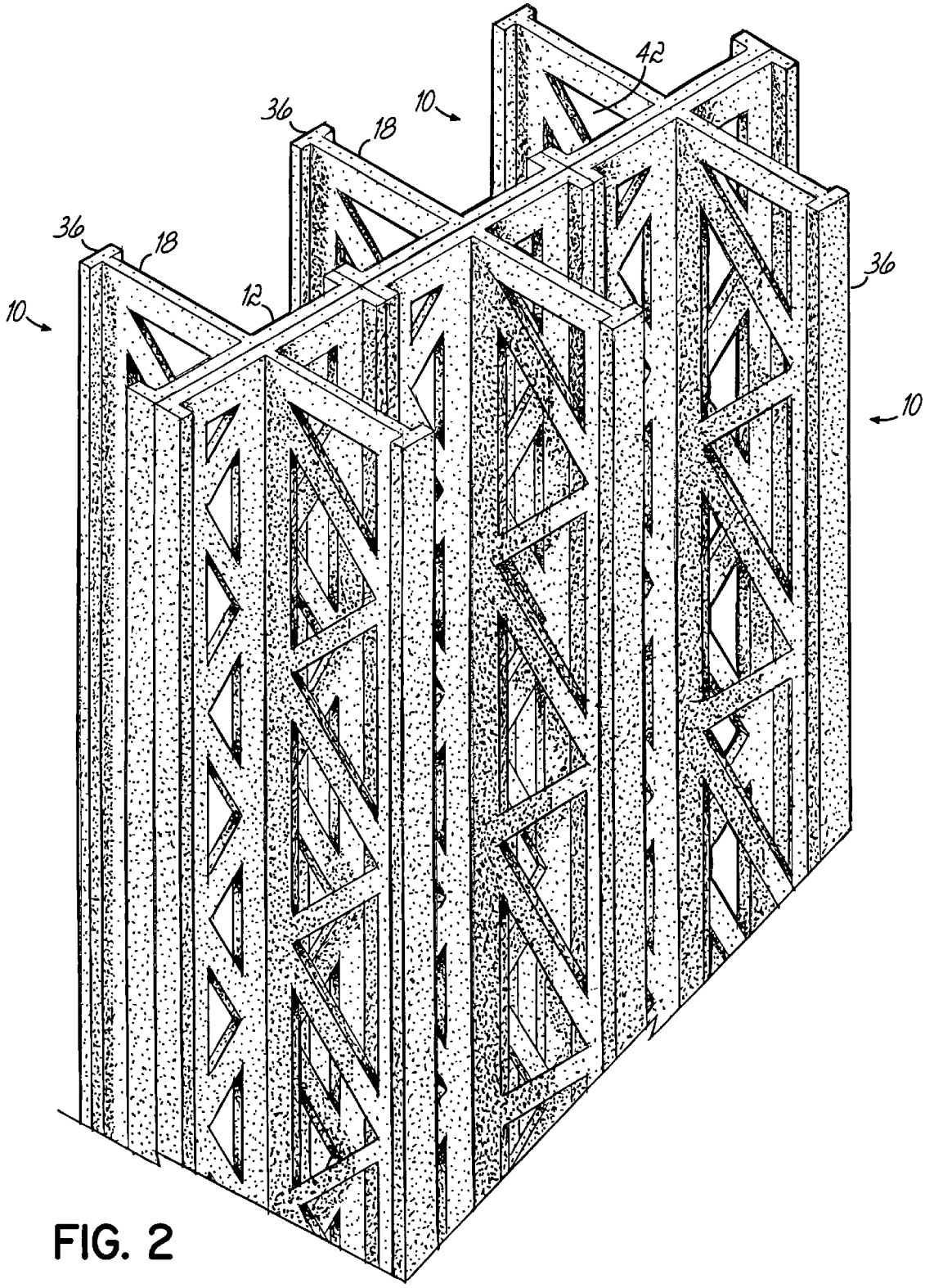
FIG. 2 is a perspective view of a plurality of slab bolster uppers nested for shipping.

Turning to FIG. 2 of the drawings, a plurality of the slab bolster uppers 10 of FIG. 1 are shown nested in a compact configuration to facilitate shipment. Thus, the inverted T-shape of the slab bolster uppers permits them to be assembled in nested relation as shown in FIG. 2, and that, together with a convenient length of the units, for example on the order of 2.5 feet each, render the slab bolster uppers of the present invention readily adapted for shipment.

Figure 3:
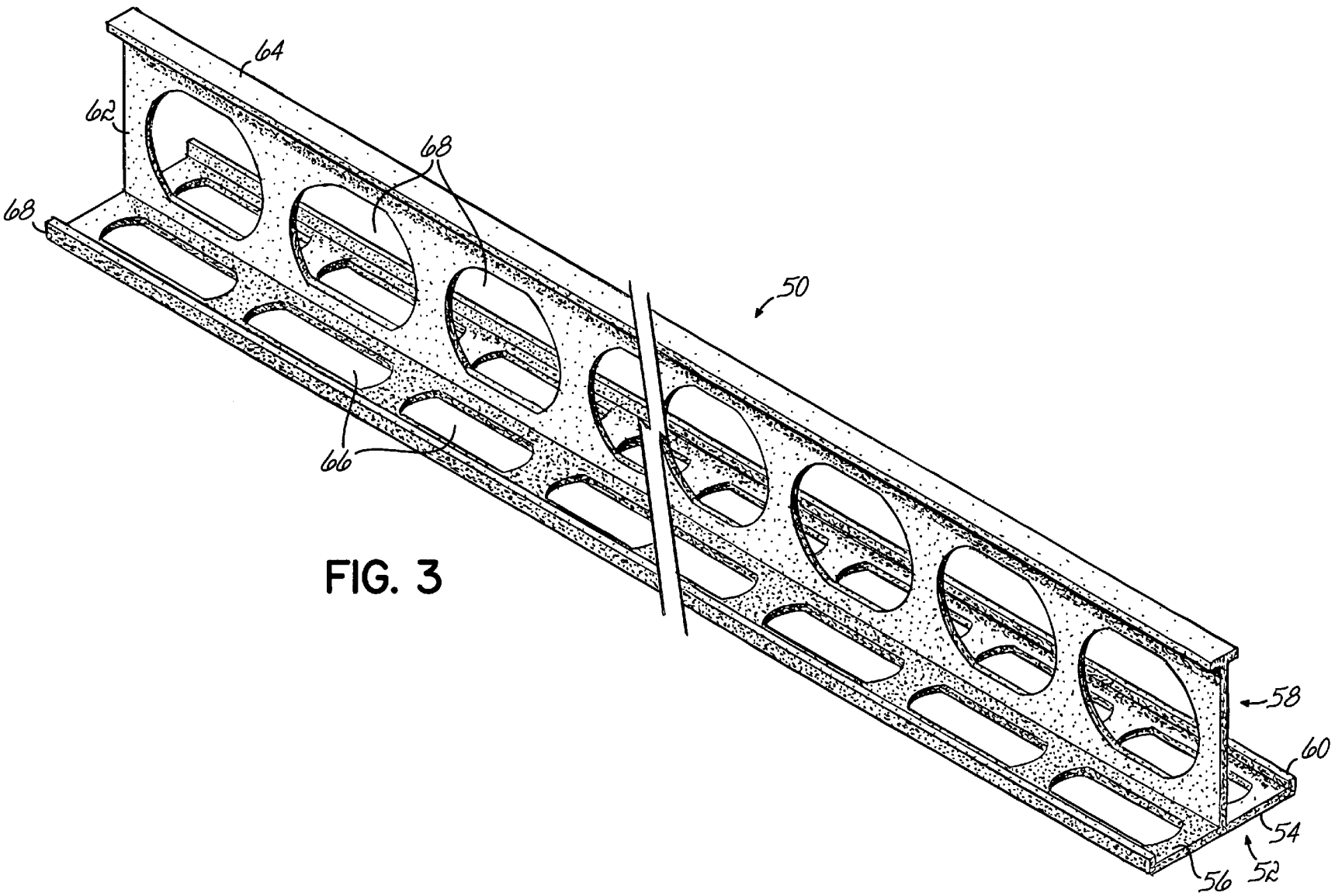
FIG. 3 is a view similar to FIG. 1 of a second preferred embodiment of the invention.

FIG. 3 of the drawings shows a second preferred embodiment 50 of the present invention, including a base 52 having a lower surface 54 and an upper surface 56 from which projects upwardly a rebar support section 58. The base 52 has upstanding ribs 60 projecting substantially perpendicularly from the upper surface 56 and extending along opposite edges 52. The rebar support section 58 has a substantially planar web 62 and a longitudinally extending cap 64 which extends in substantially parallel relationship to the base 52. Both the base and the rebar support section are provided with large voids, 66 in the base and 68 in the rebar support section, which, as seen in FIG. 3, comprise a major portion of the base and the rebar support section, and as in the embodiment of FIG. 1, facilitate flow of concrete through and around the bolster 50.

Figure 4:
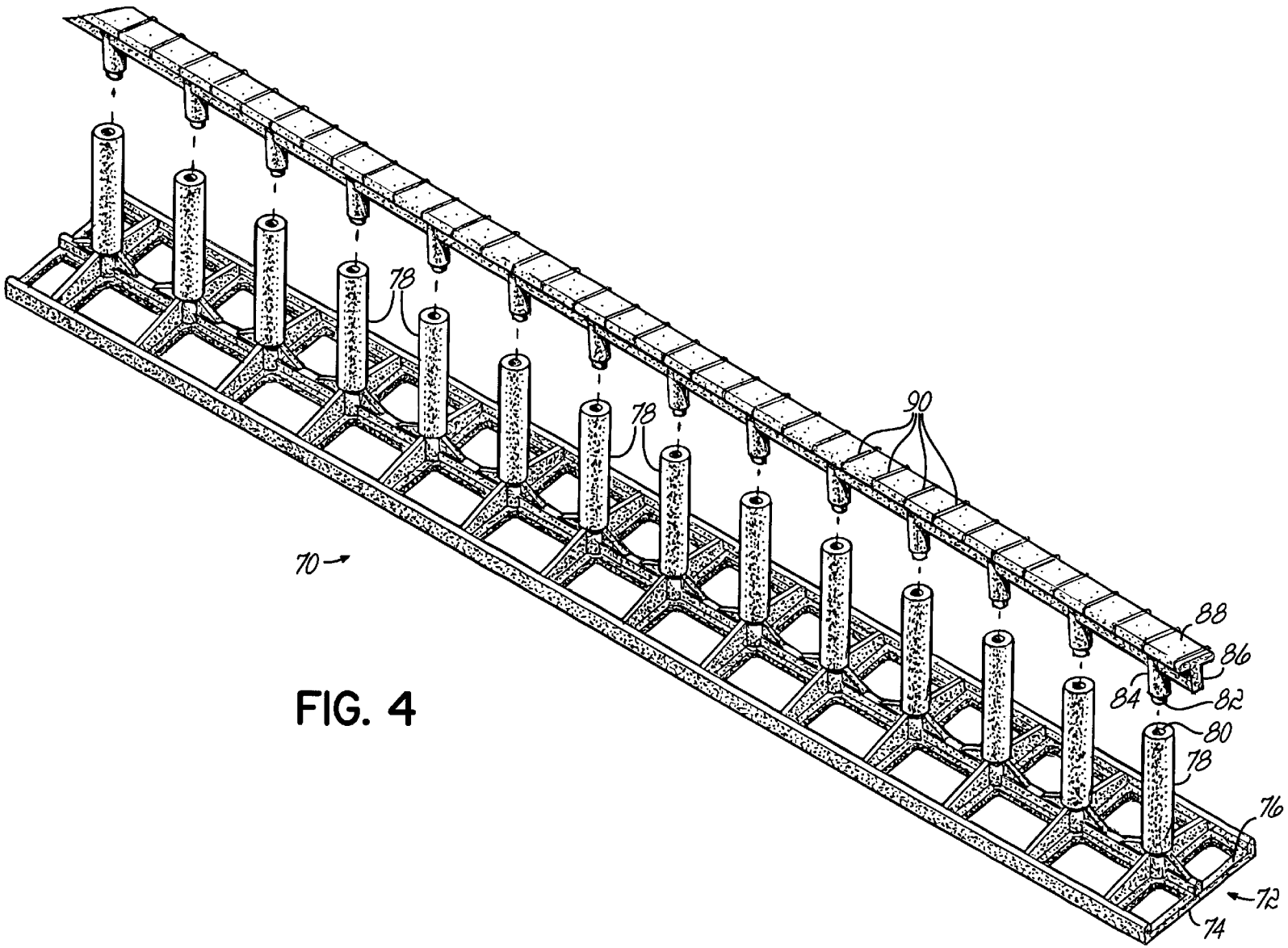
FIG. 4 is an exploded perspective view of another preferred embodiment of the invention.

FIG. 4 is an exploded perspective view of another embodiment 70 of the present invention. As seen in FIG. 4, a slab bolster upper 70 comprises a base 72 having a lower surface 74 and an upper surface 76, from which project a series of regularly spaced posts 78 having sockets 80 in their outer ends adapted to receive pins 82 formed integrally on short cap members 84 molded integrally with a central rib 86 formed on a rebar engaging cap 88. The latter, it will be noted, is provided with a series of regularly spaced transverse ridges 90. The posts 78 and a cap 88 with their associated, integrally molded joint element 80, 82 and 84, comprise a rebar support section 91 when assembled as seen in FIG. 5 of the drawings.

Figure 5:
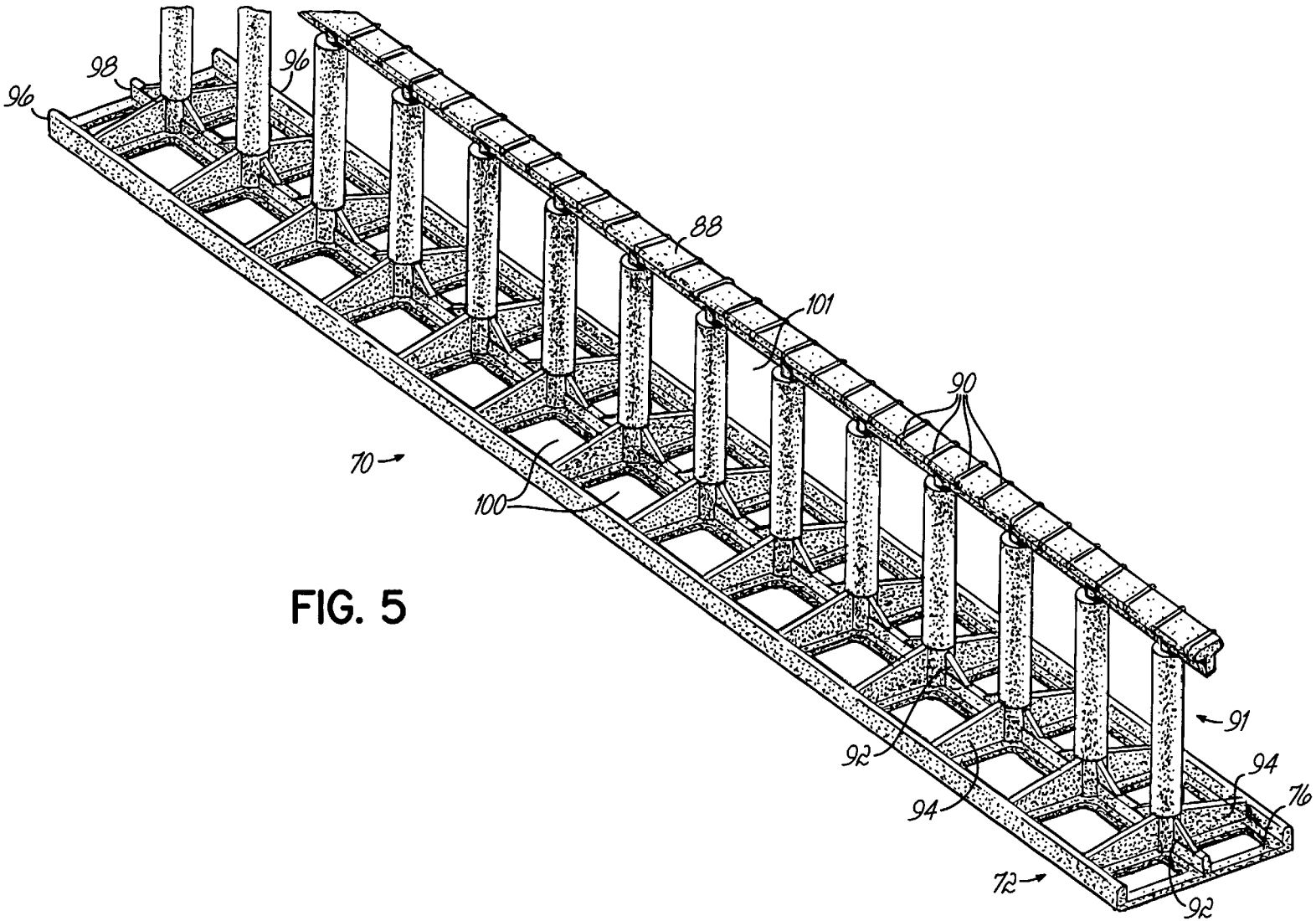
FIG. 5 is a perspective view of the embodiment of FIG. 4 showing the slab bolster upper assembled.

As shown in both FIGS. 4 and 5 of the drawings, at the juncture of each post 78 with the upper surface 76 of the base 72, longitudinally extending gussets 92 and transversely extending gussets 94 project upwardly from the upper surface 76 of the base 72. Along opposite side edges of the base 72 are a pair of longitudinally extending ribs 96, while medially thereof a third rib 98 extends parallel to the ribs 96. It will also be seen from FIG. 5 of the drawings that a series of voids 100 are formed through the base 72 while the spacing of the posts 78 provides further voids 102 defined by the posts, the upper surface of the base, and the cap 88, which voids comprise a major portion of the base and support section, respectively.

In all three embodiments of the invention thus described, it will be noted that the large voids, both horizontally and vertically, break up shear planes that would be created in the structure in which the bolster is embedded and contribute to cracking and weakness. The same function is also served by the longitudinally extending ribs with which all three embodiments are provided and the ridges 90 on the cap 88, which, although shown only in the embodiment of FIG. 5 of the drawings, are also applicable to the embodiments shown in FIGS. 1 and 3. While the embodiment of FIG. 5 is preferably of injection molded construction of various plastic material as noted above with respective to FIG. 1, the embodiments of FIGS. 1 and 3 may be formed by other methods such as by extrusion, stamping, machining, or any combination thereof. All embodiments may be reinforced with a variety of fibers as also discussed above.

Up to this point, the slab bolster uppers of the present invention have been described as discrete units that would usually be used alone. However, in accordance with the present invention, any of the three embodiments discussed so far may be provided with complementary buckles on opposite ends to permit them to be joined with like units. For purposes of illustration, buckle construction will be described in conjunction with an embodiment similar to that of FIG. 5, although it will be apparent that the same buckle construction is equally applicable to the embodiments of FIGS. 1 and 3.

Figure 6:
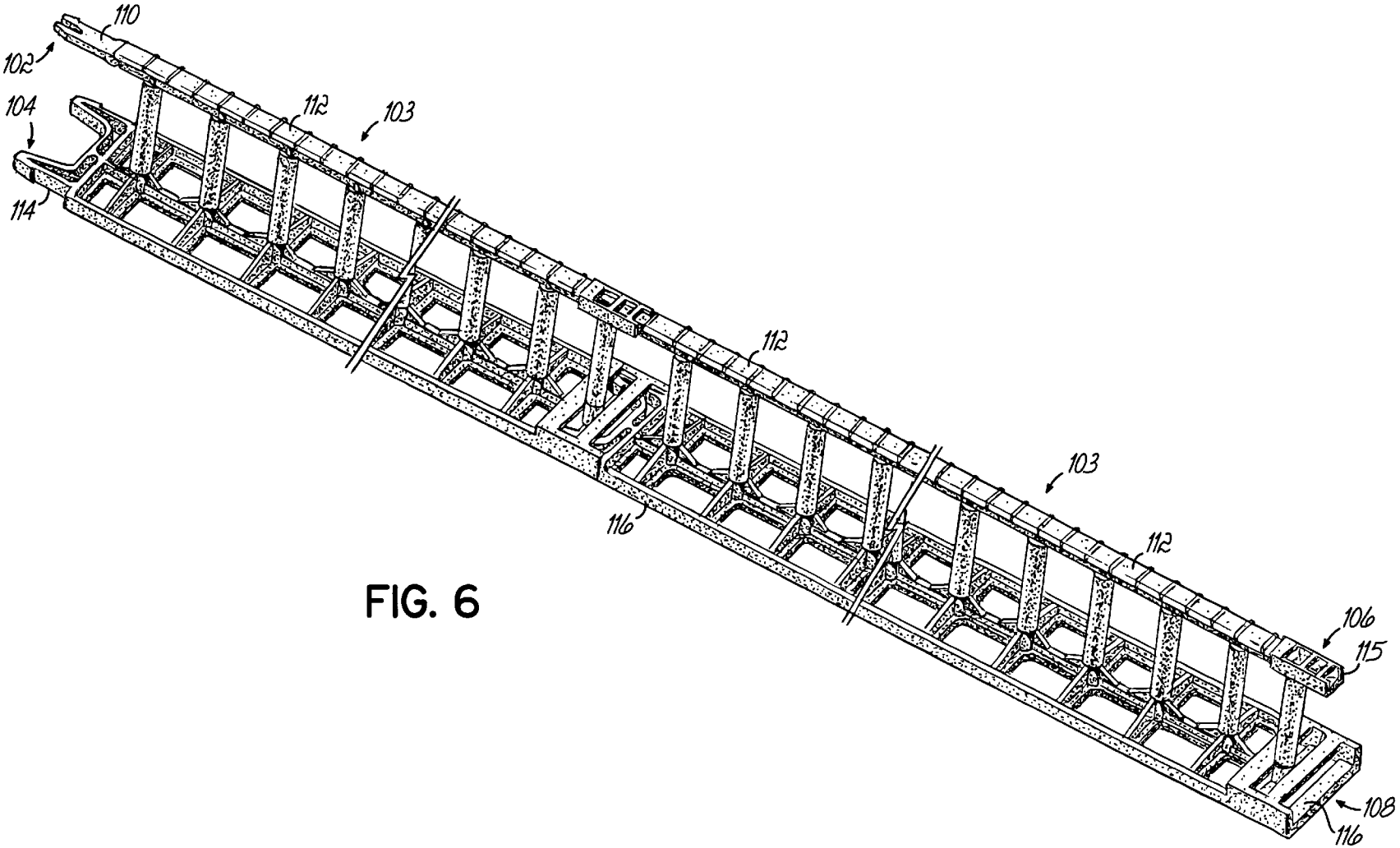
FIG. 6 is a perspective view of two units of the type shown in FIG. 5 interconnected by complementary buckles.
Figure 7:
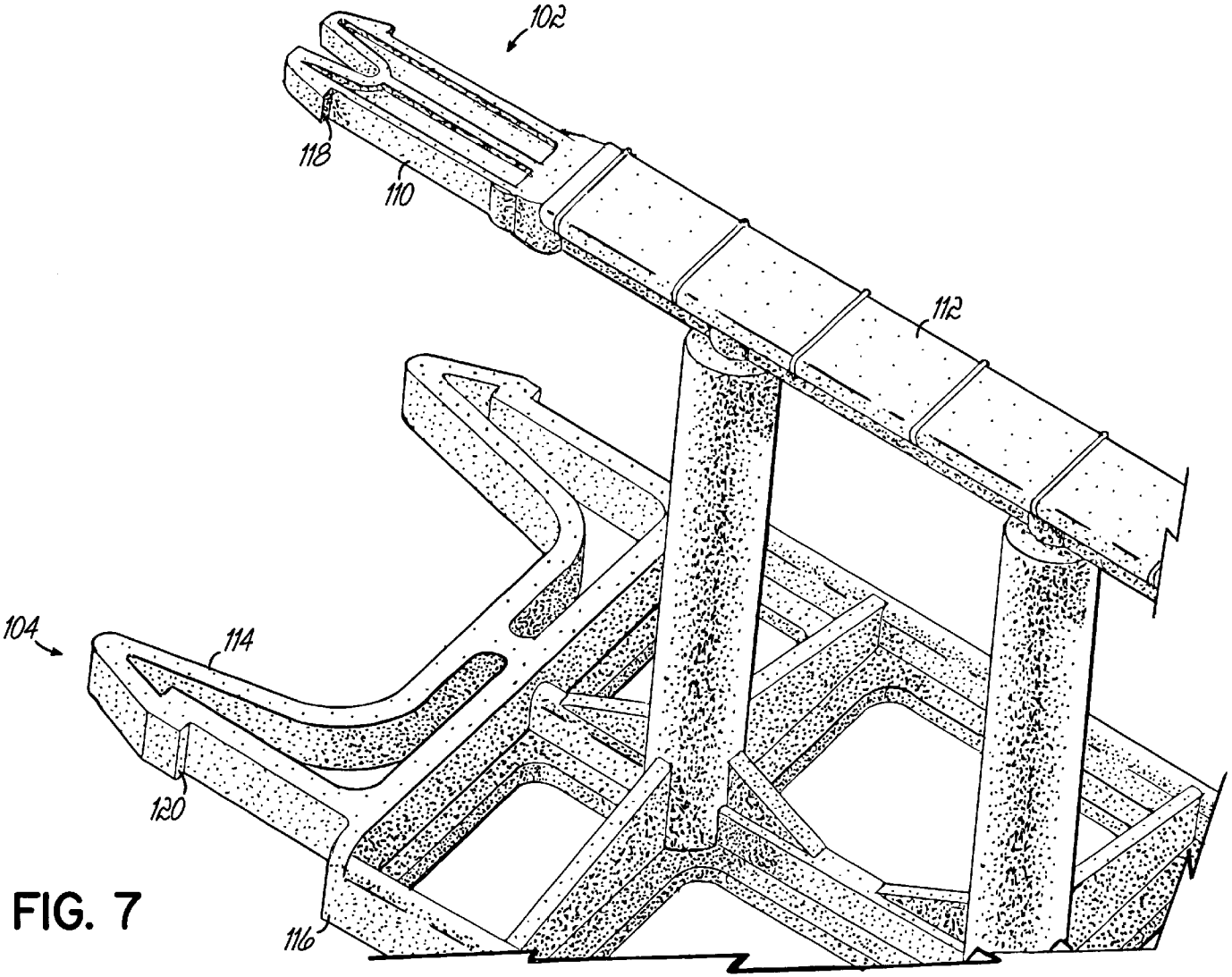
FIG. 7 is an enlarged perspective view showing the buckle construction at one end of the slab bolster upper.
Figure 8:
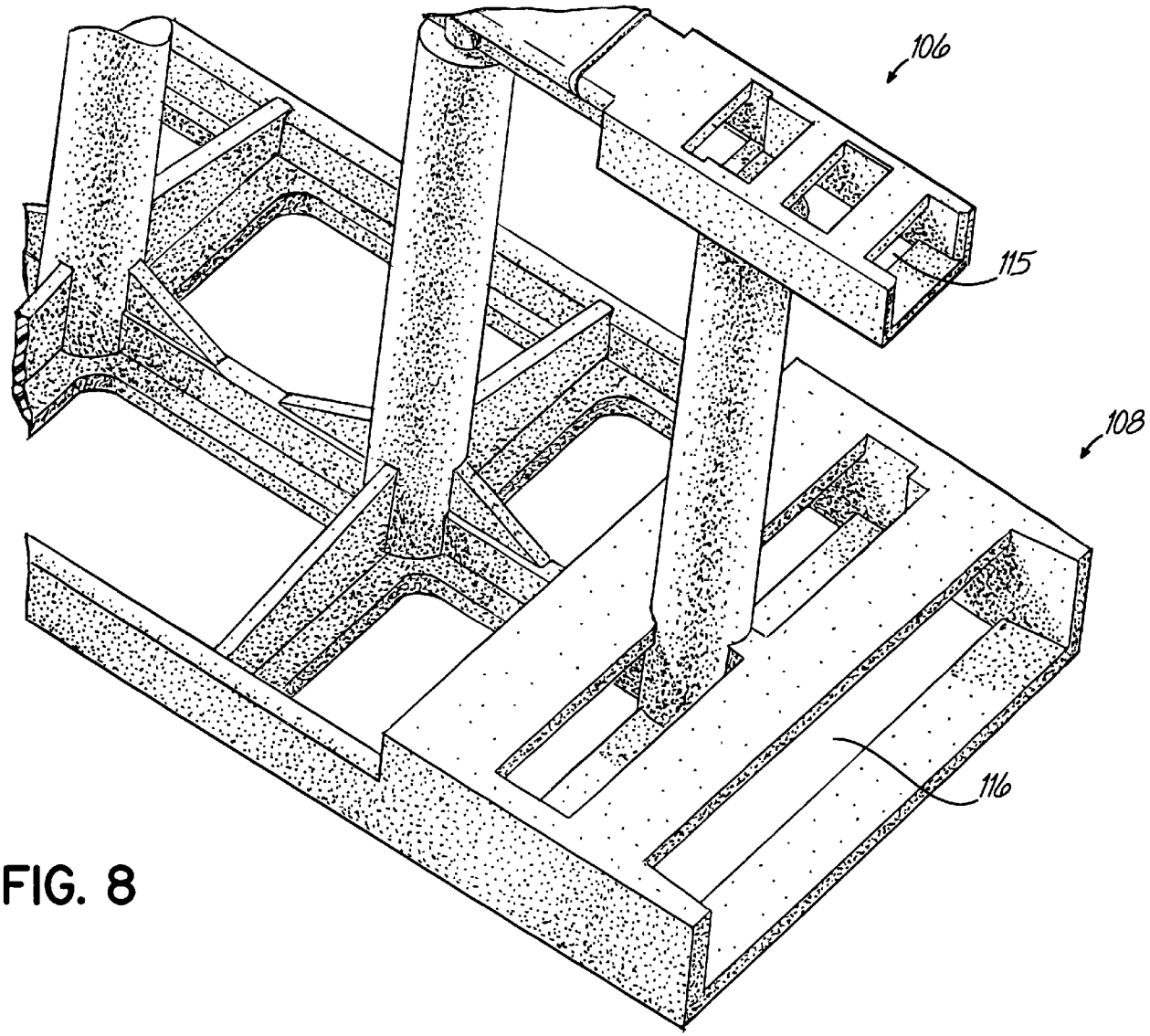
FIG. 8 is a view similar to FIG. 7, but showing the buckle construction at the opposite end of a slab bolster upper.

With reference, therefore, to FIG. 6 of the drawings, it will be seen that multiple slab bolster uppers 103 in accordance with the present invention are joined end to end with complementary buckle constructions 102, 104, 106 and 108. With reference also to FIGS. 7 and 8 of the drawings, it will be seen that the left end of each unit 103 is provided with upper and lower hasps, the upper hasp 110 being molded integrally with the cap 112, while the lower hasp 114 is molded integrally with the base 116. On the opposite end of each unit 103 are sockets 115 and 116, which are complementary with and receive the upper and lower hasps 110 and 114. As will be apparent from an inspection of FIGS. 6–8, as the hasps 110 and 114 are inserted into the sockets 115 and 116, the projections 118 on the upper hasp 110 and 120 on the lower hasp 114 lock the hasps in place in their complementary sockets.

Figure 9:
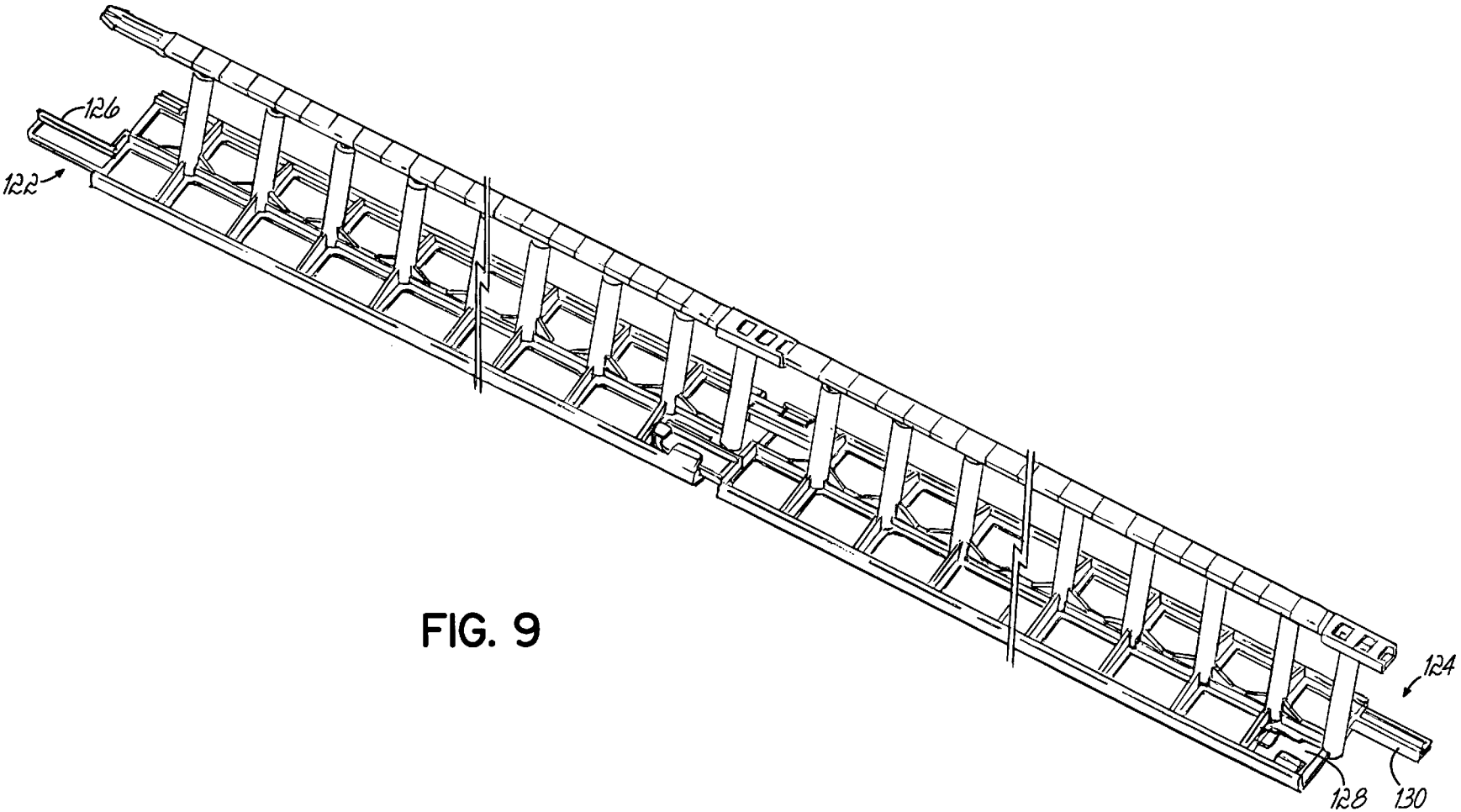
FIG. 9 is a view similar to FIG. 6, but showing a second preferred embodiment of buckle.
Figure 10:
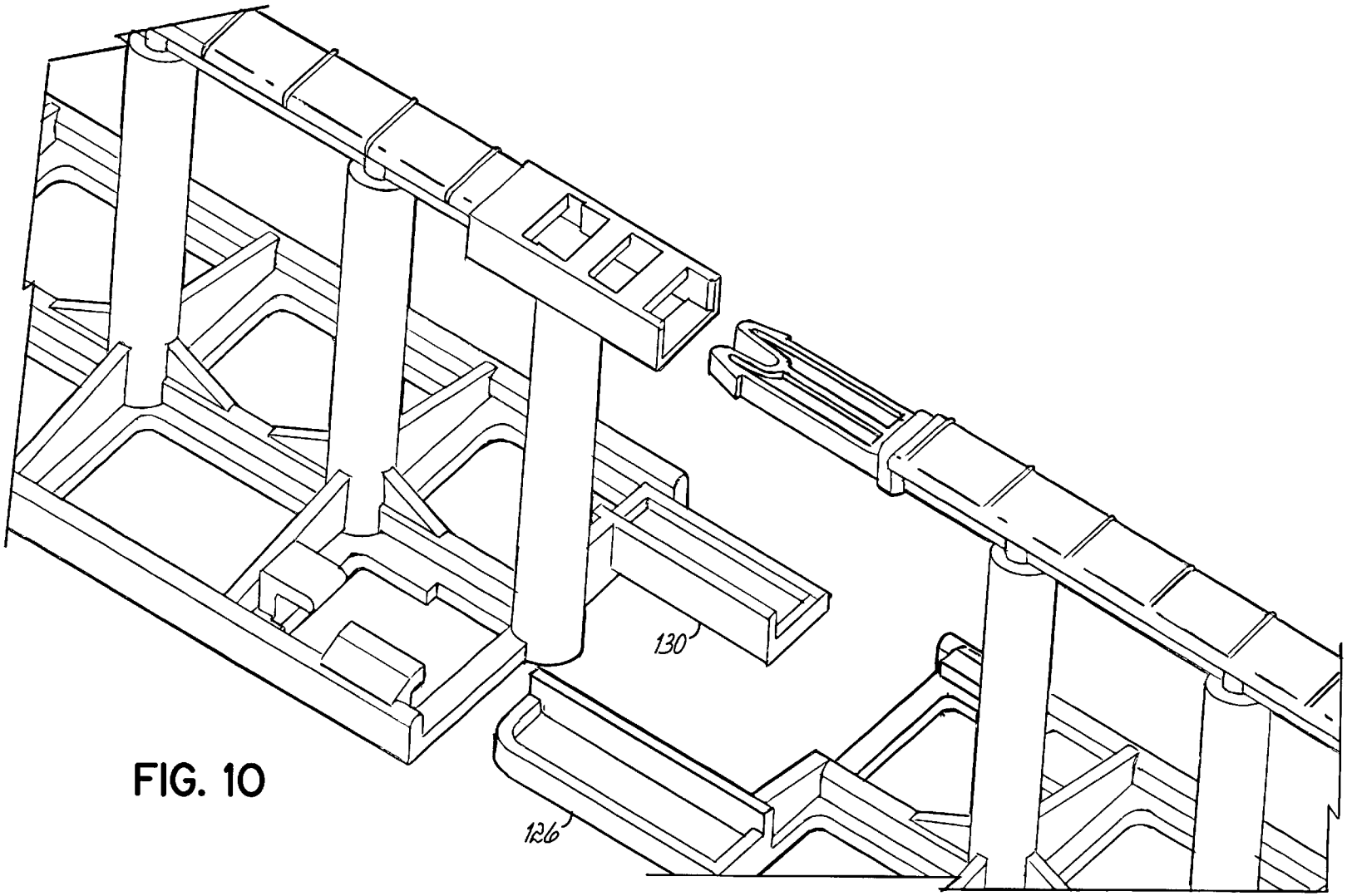
FIG. 10 is an enlarged perspective view showing the complementary buckle of FIG. 9 with the components disengaged.
Figure 11:
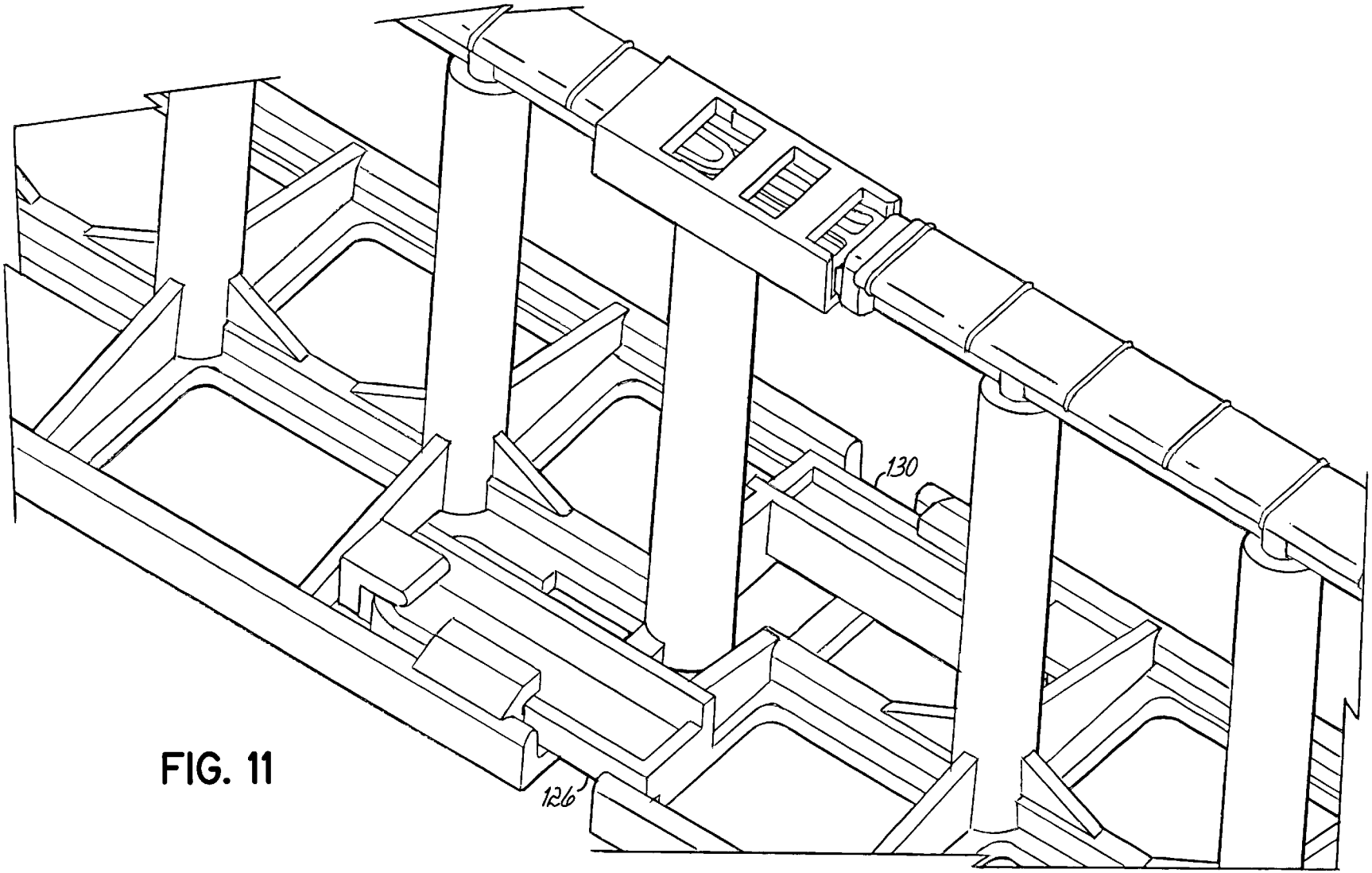
FIG. 11 is a view similar to FIG. 10, but showing the complementary buckle components engaged.

FIGS. 9–11 show a further form of complementary buckles for joining successive units of slab bolster uppers of the present invention. As seen in FIGS. 9–11, the complementary buckles 112 and 124 comprise a projecting member 126 receivable in the socket 128 on the opposite end of a like unit. A stabilizing portion 130 projects from the buckle 124 and is received in overlying relationship to the base of the slab bolster upper for stabilizing effect.

Figure 12:
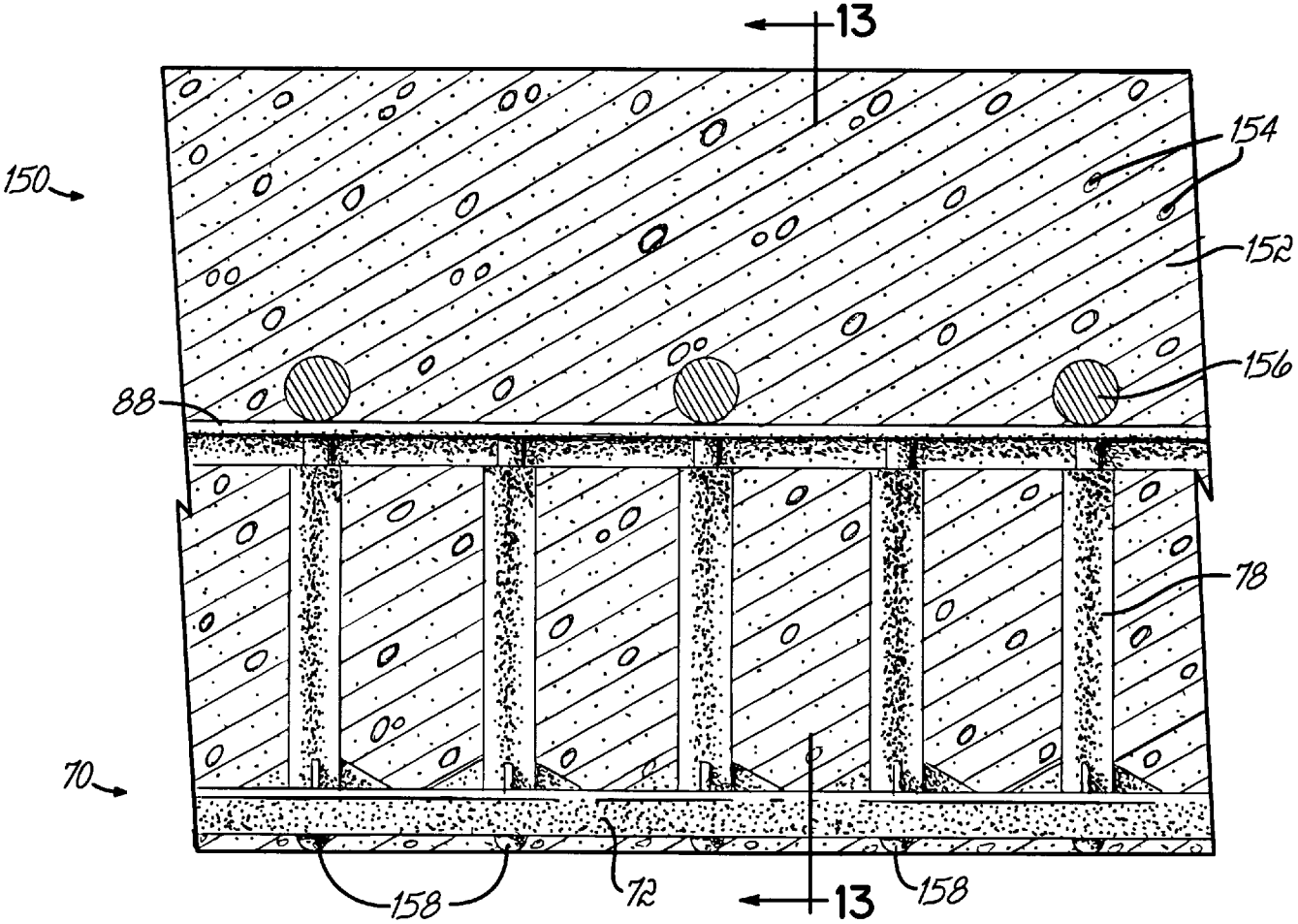
FIG. 12 shows the slab bolster upper of FIG. 5 embedded in a reinforced concrete structure.
Figure 13:
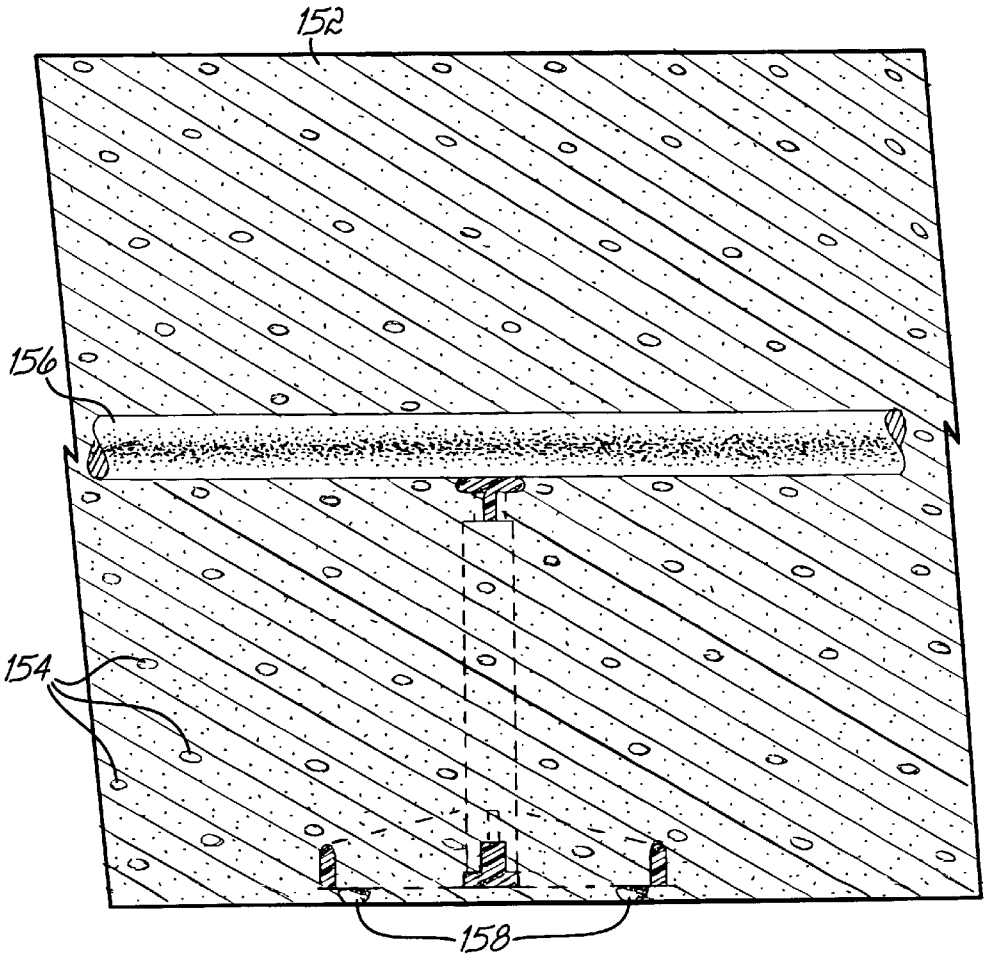
FIG. 13 is a view taken on line 13—13 of FIG. 12.

FIGS. 12 and 13 depict a slab bolster upper in a reinforced concrete structure. For purposes of illustration, the embodiment of FIG. 5 of the invention is depicted in FIGS. 12 and 13, although it will be apparent that any of the embodiments thus far described would perform nearly identically. A reinforced concrete structure 150, including concrete 152 containing aggregate 154 and reinforced with rebars 156 is shown in conjunction with a slab bolster upper 70. A plurality of posts 78 carry the rebar engaging cap 88 upon which the rebars 156 are positioned. It will be understood that a desired vertical location of the rebars 156 may be achieved by selectively varying the dimensions of the slab bolster upper, such as by varying the height dimensions of the posts 78 or the base 72. Alternatively, a desired vertical location of the rebars 156 may be achieved by varying the dimensions of the rebar engaging cap 88, such as the height of the central rib 86 or the length of short cap members 84. Additionally, a lower surface of the base 72 in FIGS. 12 and 13 is provided with projections 158 extending from the lower surface of the base 72 to space the base slightly above the surface of the underlying form. As seen in FIGS. 12 and 13, this permits the concrete to spread beneath the lower surface of the base 72. Although the embodiment of FIG. 5 of the drawings is depicted for purposes of illustrating the projections 158, it will be apparent that any of the embodiments of the present invention may be provided with similar projections for the same purpose.

Figure 12A:
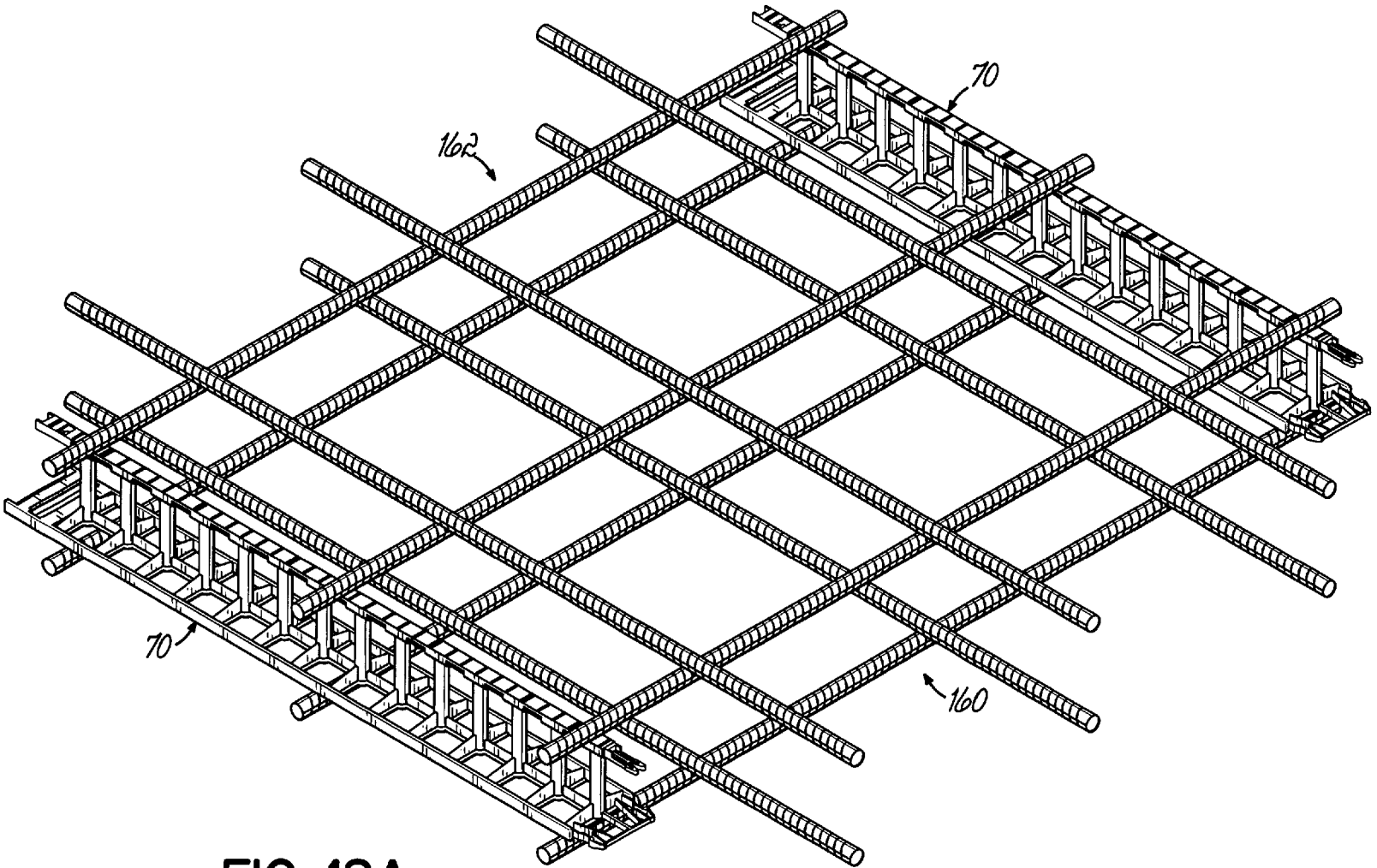
FIG. 12A shows slab bolster uppers of FIG. 5 atop a lower matte of rebars and supporting an upper matte of rebars.

FIG. 12A depicts an exemplary use of the slab bolster upper 70 for which the present invention is particularly suited. As shown in the figure, slab bolster uppers 70 may be positioned atop a lower matte of rebar 160 to support an upper matte of rebar 162 in spaced relation to the lower matte 160. This type of arrangement may be used, for example, in the formation of a tilt-up concrete panel where it is desired to avoid the placement of large footprint items near the bottom surface of the panel which will eventually be exposed when the panel is raised into position.

Figure 14:
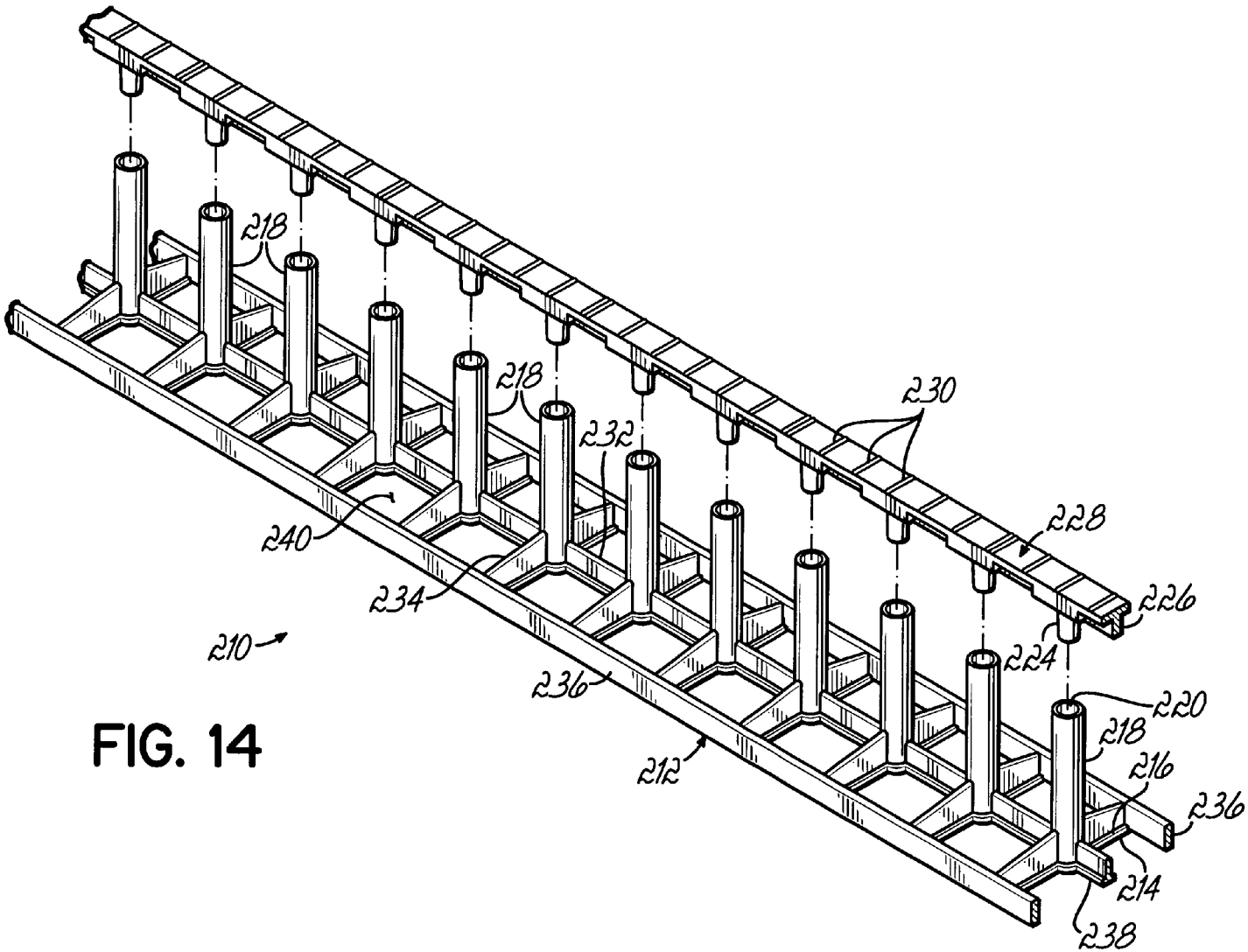
FIG. 14 is an exploded perspective view of another exemplary slab bolster upper of the present invention.

FIG. 14 is an exploded perspective view of yet another embodiment 210 of the present invention. As seen in FIG. 14, a slab bolster upper 210 comprises a base 212 having a lower surface 214 and an upper surface 216, from which project a series of regularly spaced posts 218 having sockets 220 in their outer ends adapted to receive pins 224 molded integrally with a central rib 226 formed on a rebar engaging cap 228. The latter, it will be noted, is provided with a series of regularly spaced transverse ridges 230. The posts 218 and a cap 228 with their associated, integrally molded joint elements 220, 224 comprise a rebar support section 231 when assembled as seen in FIG. 15 of the drawings.

Figure 15:
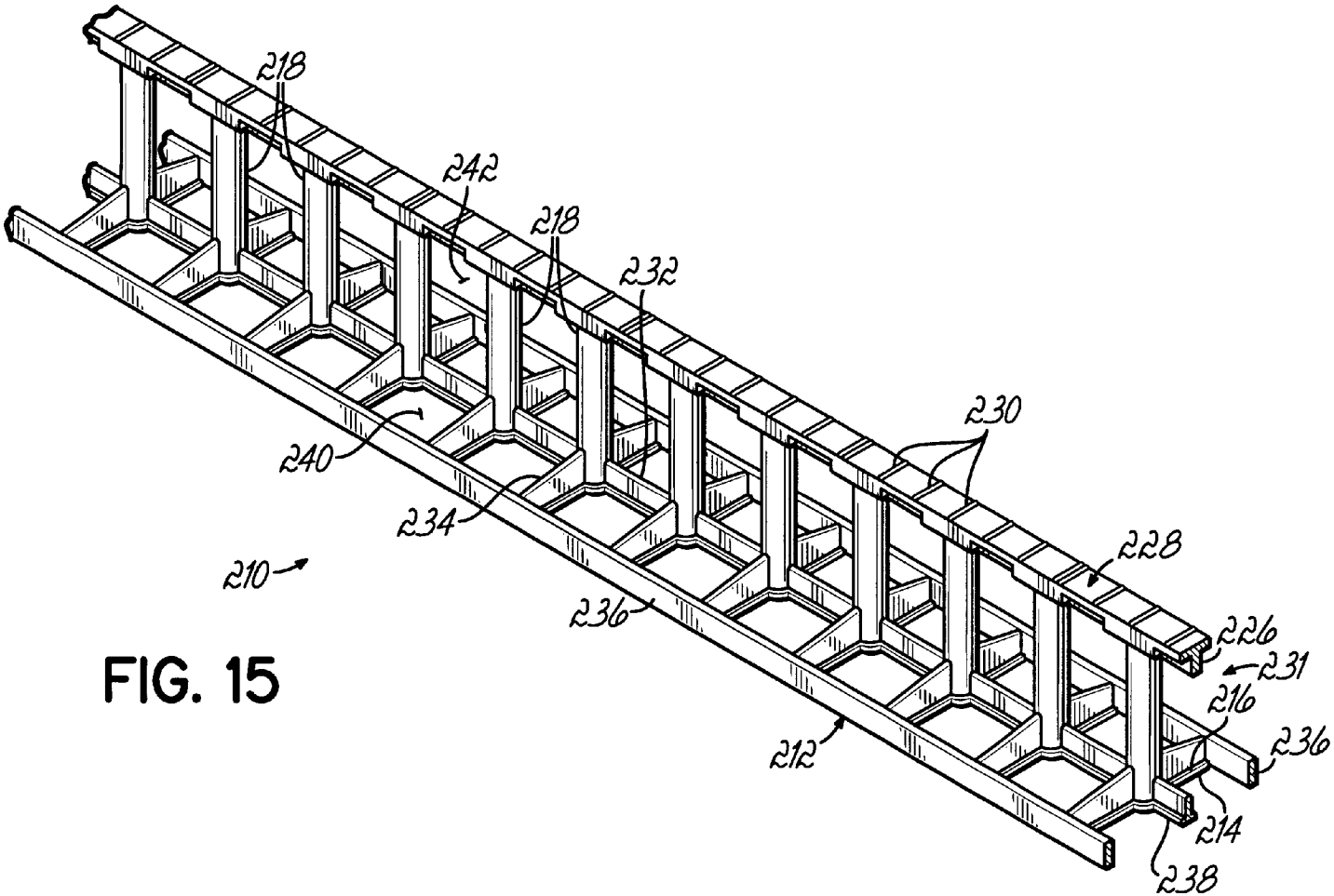
FIG. 15 is a perspective view of the exemplary embodiment of FIG. 14, showing the slab bolster upper assembled.

As shown in both FIGS. 14 and 15 of the drawings, at the juncture of each post 218 with the upper surface 216 of the base 212, longitudinally extending gussets 232, between adjacent posts 218, and transversely extending gussets 234 project upwardly from the upper surface 216 of the base 212. Along opposite side edges of the base 212 are a pair of longitudinally extending ribs 236, while medially thereof a third rib 238 extends parallel to the ribs 236. It will also be seen from FIG. 15 of the drawings that a series of voids 240 are formed through the base 212 while the spacing of the posts 218 provides further voids 242 defined by the posts 218, the upper surface 216 of the base 212, and the cap 228, which voids 240, 242 comprise a major portion of the base 212 and support section 231, respectively.

As described above, the large voids 240, 242 both horizontally and vertically, break up shear planes that would be created in the structure in which the bolster 210 is embedded and contribute to cracking and weakness. The same function is also served by the longitudinally extending ribs 232 and the ridges 230 on the cap 228.

In accordance with the present invention, the slab bolster upper 210 embodiment of FIGS. 14 and 15 may be used individually or may be provided with complementary buckles 250, 252, 254, 256 on opposite ends to permit several units to be joined together as described above.

Figure 16:
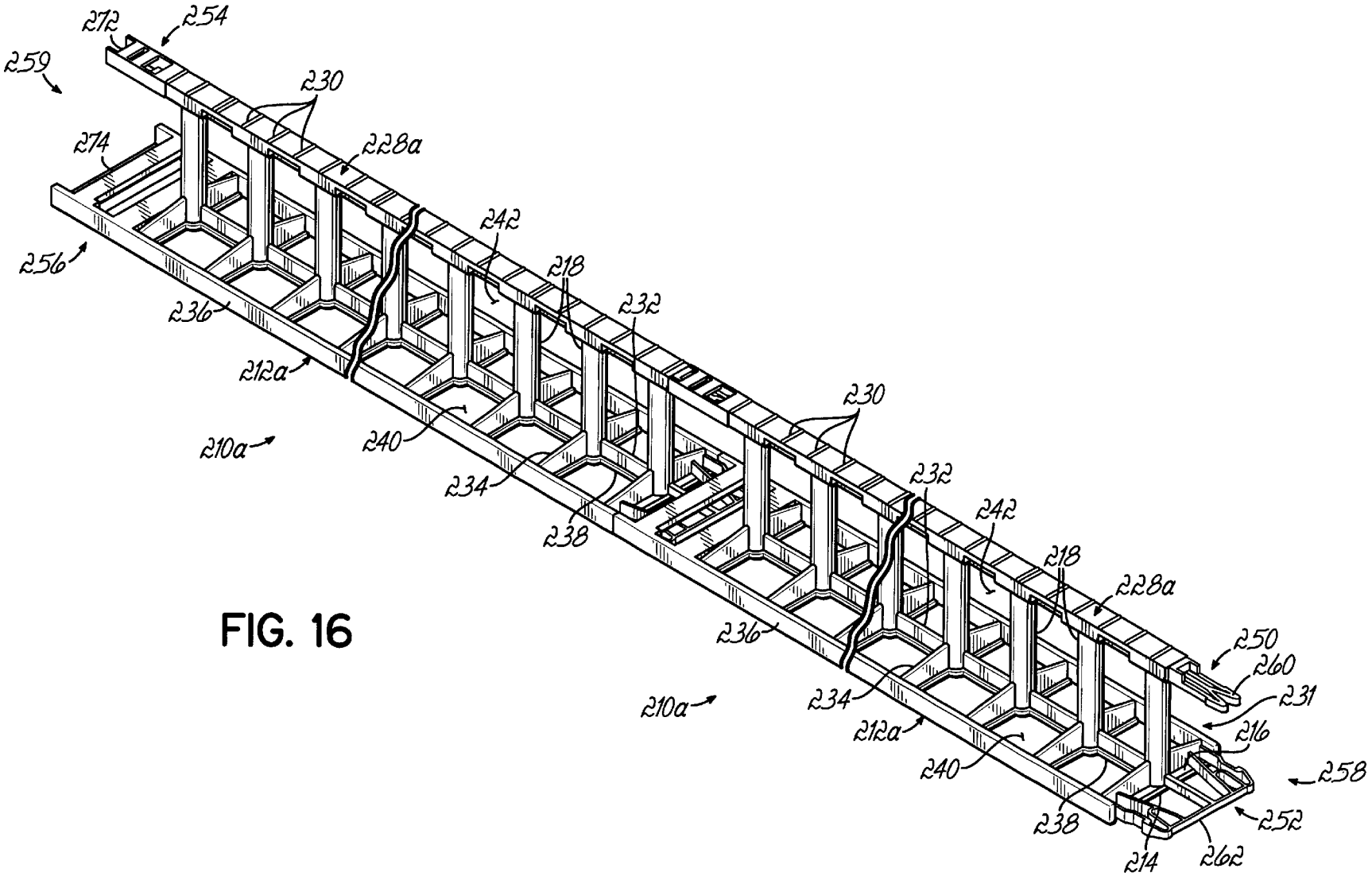
FIG. 16 is a perspective view of a series of slab bolster uppers of FIG. 15 interconnected by complementary buckles.
Figure 18:
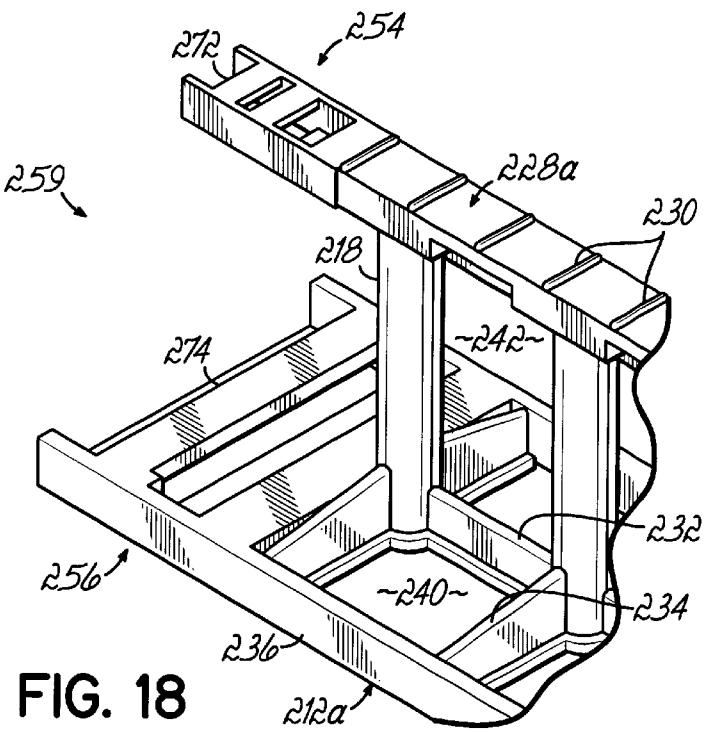
FIG. 18 is an enlarged perspective view showing the exemplary buckle construction at another end of a slab bolster upper of FIG. 16.
Figure 17:
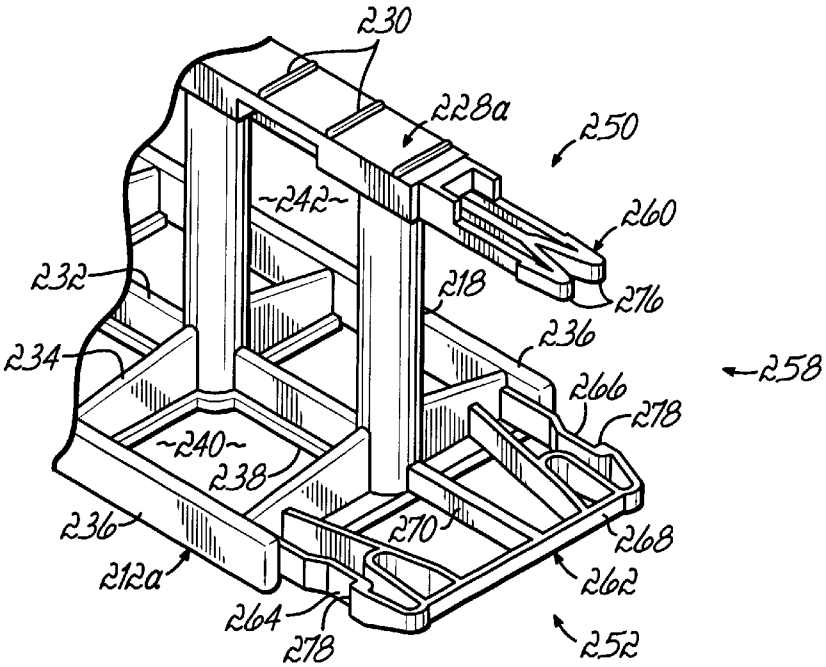
FIG. 17 is an enlarged perspective view showing the exemplary buckle construction at one end of a slab bolster upper of FIG. 16.

With reference, therefore, to FIGS. 16–18, it will be seen that multiple slab bolster uppers 210*a* in accordance with the present invention are joined end to end with complementary buckle constructions 250, 252, 254, and 256. As shown more clearly in FIGS. 17 and 18, it will be seen that a first end 258 of each unit 210*a* is provided with upper and lower hasps 260, 262, the upper hasp 260 being molded integrally with the cap 228*a*, while the lower hasp 262 is molded integrally with the base 212*a*. As shown in FIG. 17, upper hasp 260 is similar to the upper hasp 110 depicted in FIG. 7. The lower hasp 262 depicted in FIG. 17 is yet another alternative buckle construction wherein first and second hasp members 264, 266 are connected by a transverse rib 268. Transverse rib 268 is further joined to the base 212*a* by a longitudinally extending rib 270.

On the opposite end 259 of each bolster 210*a* are sockets 272 and 274, which are complementary with and receive the upper and lower hasps 260 and 262. As will be apparent from an inspection of FIGS. 16–18, as the hasps 260 and 262 are inserted into the sockets 272 and 274, the projections, 276 on the upper hasp 260 and 278 on the lower hasp 262, lock the hasps 260, 262 in place in their complementary sockets 272, 274, respectively.

It is understood that the embodiments of slab bolster upper 210, 210*a* depicted in FIGS. 14–18 may be used individually, or joined in series, to support rebar during the formation of a reinforced concrete structure, as described above and depicted in FIGS. 12 and 13. Accordingly, the discussion with respect to FIGS. 12 and 13 is fully applicable to slab bolster upper embodiments 210 and 210*a*.

While the present invention has been illustrated by the description of an embodiment thereof, and while the embodiment has been described in considerable detail, it is not intended to restrict or in any way limit the scope of the appended claims to such detail. Additional advantages and modifications will readily appear to those skilled in the art. For example, while the general construction of the slab bolster upper of the present invention has been illustrated and described in the various embodiments herein as having an inverted T-shape, it will be recognized that the features of the slab bolster upper may be applied to other shapes as well. For example, the features of the slab bolster uppers described herein may be applied to I-beam or U-channel shapes.

The invention in its broader aspects is therefore not limited to the specific details, representative apparatus and method and illustrative examples shown and described. Accordingly, departures may be made from such details without departing from the scope or spirit of Applicant's general inventive concept.

What is claimed is:

1. A slab bolster upper, comprising;

an elongate base, having lower and upper surfaces;

at least three posts projecting from said upper surface of said base;

an elongate support section proximate said plurality of posts, said support section configured to engage and support concrete reinforcing rods;

a first plurality of gussets, extending in directions transverse to said base, from opposing sides of each of said plurality of posts; and a second plurality of gussets, extending in a longitudinal direction along said base and between said plurality of posts.

2. The slab bolster upper of claim 1, wherein said plurality of posts include sockets formed into distal ends of said posts and wherein said support section includes pins configured to be received in said sockets, whereby said support section may be coupled to said posts.

3. The slab bolster upper of claim 1, further comprising:

complementary buckle constructions proximate opposing ends of said elongate base and said support section, whereby plural slab bolster uppers may be arranged end-to-end and coupled together using said buckle constructions.

4. The slab bolster upper of claim 3, wherein said buckle constructions include hasps formed at ends of said base and support sections.

5. The slab bolster upper of claim 4, wherein said hasp on said base section includes at first and second hasp members connected by a transversely extending rib and joined to said base by a longitudinally extending rib.

6. The slab bolster upper of claim 1, wherein said base section and said support section are formed from plastic.

7. The slab bolster upper of claim 6, wherein said base and support sections are formed from a group consisting of polycarbonate/acrylonitrile butadiene styrene, polypropylene, and nylon.

8. A concrete construction, comprising:

a slab bolster upper, comprising:

an elongate base, having lower and upper surfaces, an elongate support section proximate said upper surface of said base, said support section configured to engage and support concrete reinforcing rods, a plurality of posts projecting from said upper surface of said base, a first plurality of gussets, extending in directions transverse to said base, from opposing sides of each of said plurality of posts, and a second plurality of gussets, extending in a longitudinal direction along said base and between said plurality of posts;

a plurality of reinforcing rods adjacent said slab bolster upper; and concrete encasing said slab bolster upper and said reinforcing rods.

9. A method of forming a concrete construction, comprising:

arranging at least one slab bolster upper in a concrete form, the slab bolster upper including:

an elongate base, having lower and upper surfaces, an elongate support section proximate the upper surface of the base, the support section configured to engage and support concrete reinforcing rods, a plurality of posts projecting from the upper surface of the base, a first plurality of gussets, extending in directions transverse to the base, from opposing sides of each of the plurality of posts, and a second plurality of gussets, extending in a longitudinal direction along the base and between the plurality of posts;

arranging at least one concrete reinforcing rod proximate said slab bolster upper; and filling said form with concrete to cover said slab bolster upper and said concrete reinforcing rod.

* * * * *